US006014952A

United States Patent [19]

Sato et al.

[11] Patent Number: 6,014,952

[45] Date of Patent: Jan. 18, 2000

[54] VALVE TIMING CONTROL APPARATUS FOR AN INTERNAL COMBUSTION ENGINE

[75] Inventors: Osamu Sato, Takahama; Kiyoshi Sugimoto, Okazaki; Yoshihito Moriya, Nagoya; Noriyuki Iden, Toyota; Shinitiro Kikuoka, Okazaki; Tadao Hasegawa, Toyota, all of Japan

[73] Assignees: Denson Corporation, Kariya, Japan; Toyota Jidosha Kabushiki Kaisha, Toyota, Japan

[21] Appl. No.: 09/152,270

[22] Filed: Sep. 14, 1998

[30] Foreign Application Priority Data

Sep. 16, 1997 [JP] Japan ..... 9-250615
Apr. 27, 1998 [JP] Japan ..... 10-117175

[51] Int. Cl.[7] ..... F01L 1/344; F01L 13/00

[52] U.S. Cl. ..... 123/90.17; 123/90.18

[58] Field of Search ..... 123/90.15, 90.17, 123/90.18, 90.31

[56] References Cited

U.S. PATENT DOCUMENTS

| | | | |
|---|---|---|---|
| 4,811,698 | 3/1989 | Akasaka et al. | 123/90.17 |
| 5,329,895 | 7/1994 | Nishida et al. | 123/90.17 |
| 5,381,764 | 1/1995 | Fukuma et al. | 123/90.17 |
| 5,638,782 | 6/1997 | Eguchi et al. | 123/90.17 |
| 5,881,690 | 3/1999 | Park | 123/90.18 |
| 5,924,397 | 7/1999 | Moriya et al. | 123/90.18 |

FOREIGN PATENT DOCUMENTS

| | | |
|---|---|---|
| 4 -255508 | 9/1992 | Japan . |
| 5 -77842 | 10/1993 | Japan . |
| 07301106 | 11/1995 | Japan . |
| 09032519 | 2/1997 | Japan . |
| 09151710 | 6/1997 | Japan . |

OTHER PUBLICATIONS

"The Variable Valve Timing System–Application on a V8 Engine" by A. Titolo.

*Primary Examiner*—Weilun Lo
*Attorney, Agent, or Firm*—Nixon & Vanderhye P.C.

[57] ABSTRACT

Each of a positive spline member and a negative spline member is engaged through a spline engagement with a vane rotor. Both the positive spline member and the negative spline member are securely fixed to a cam shaft by means of a bolt. The cam shaft causes an axial reciprocative movement relative to the vane rotor. Each external spline formed on the positive spline member is brought into contact at its trailing side with an internal spline of the vane rotor. Each external spline formed on the negative spline member is brought into contact at its leading side with an internal spline of the vane rotor. This arrangement eliminates any backlash formed between the internal splines of the vane rotor and the external splines of the positive and negative spline members.

8 Claims, 12 Drawing Sheets

VALVE TIMING CONTROL APPARATUS FOR AN INTERNAL COMBUSTION ENGINE

BACKGROUND OF THE INVENTION

The present invention relates to a valve timing control apparatus preferably used for optimizing an open or close timing of at least one of an intake or exhaust valve of an internal combustion engine in accordance with engine operating conditions.

Various valve timing control apparatuses are conventionally known as an advanced mechanism installed in an internal combustion engine for adjusting a rotational phase difference between a crank shaft and a cam shaft. For example, Published Japanese Patent Application No. Kokai 9-32519 discloses one conventional valve timing control apparatus for varying a valve timing and/or a lift amount of at least one of intake and exhaust valves by shifting a cam shaft in an axial direction to select a preferable cam engaged with the valve from different cams aligned in the axial direction. According to the conventional valve timing control apparatus disclosed in Published Japanese Patent Application No. Kokai 9-32519, a sleeve is interposed between a timing pulley and a cam shaft. This sleeve rotates together with the timing pulley and engages with the cam shaft through a spline engagement. With a controlled rotational phase difference, the driving force is transmitted from the crank shaft to the cam shaft. The cam shaft can cause a reciprocative slide movement in an axial direction.

To satisfy various requirements for improving engine performances, there is a necessity of more accurately controlling the valve timing of each intake or exhaust valve. However, a highly accurate valve timing control cannot be realized without improvement of the mechanical or hardware arrangement for controlling the rotational phase difference between the crank shaft and the cam shaft as well as improvement of an axial shift mechanism of the cam shaft equipped with a plurality of different cams.

Furthermore, according to the valve timing control apparatus disclosed in Published Japanese Patent Application No. Kokai 9-32519, a significant backlash is caused between splines (i.e., spline keys) in the spline engagement between the cam shaft and the sleeve. This backlash causes undesirable hammering noise from the spline engagement in response to a positive or negative variation of the torque applied on the cam shaft during the open and close control of the intake or exhaust valve.

SUMMARY OF THE INVENTION

In view of the problems encountered in the prior art, an object of the present invention is to provide a valve timing control apparatus for accurately controlling open and close timings of an intake or exhaust valve of an internal combustion engine.

Another object of the present invention is to provide a valve timing control apparatus compact in size.

Another object of the present invention is to provide a valve timing control apparatus excellent in response to control the valve timing.

Another object of the present invention is to provide a valve timing control apparatus for suppressing hammering noise generated from a spline engagement between the driven shaft and the driven rotary body.

In order to accomplish these and other related objects, an aspect of the present invention provides a valve timing control apparatus provided in a driving force transmitting mechanism for transmitting a driving force of an internal combustion engine to a driven shaft with a plurality of cams aligned in an axial direction and having different contours defining cam profiles for opening or closing at least one of intake and exhaust valves. The valve timing control apparatus comprises a driving rotary body rotating in synchronism with a driving shaft of the internal combustion engine. At least one spline member rotates integrally with the driven shaft. A driven rotary body causes an angular displacement relative to the driving rotary body in response to a hydraulic pressure. The driven rotary body engages with the spline member through a spline engagement so as to allow the driven shaft to shift in the axial direction.

Preferably, either the driving rotary body or the driven rotary body is a vane rotor and the other is a housing accommodating the vane rotor, allowing a relative displacement between the vane rotor and the housing within a predetermined angular region.

Preferably, the spline member comprises a first spline member and a second spline member. Each spline (i.e., spline key) formed on the first spline member is brought into contact at its trailing side with a mating spline of the driven rotary body. Each spline formed on the second spline member is brought into contact at its leading side with a mating spline of the driven rotary body.

Preferably, an urging means is provided for resiliently urging the first spline member in a direction opposed to a rotational direction and for resiliently urging the second spline member in the same direction as the rotational direction.

Preferably, the urging means is constituted by one spline member having an inner cylindrical surface engaged through a helical spline engagement with a smaller-diameter member serving as the other spline member. A spring member resiliently urges the spline member.

Preferably, the urging means is constituted by a wedge member accommodated in a cutout formed in each of the first spline member and the second spline member. A spring pushes the wedge member for resiliently urging the first spline member in the direction opposed to the rotational direction and resiliently urging the second spline member in the same direction as the rotational direction.

Preferably, a plurality of hydraulic chambers are provided for hydraulically pushing the driven rotary body to cause the angular displacement relative to the driving rotary body in a retard direction and an advance direction. A slide portion is provided between the driven shaft and a bearing portion of the driven shaft for providing a sealing between two fluid passages supplying hydraulic fluid to the hydraulic chambers.

Preferably, a ring passage is formed along an inner cylindrical wall of the bearing portion so as to communicate with the hydraulic chambers, and an adjusting chamber is provided in one of the two fluid passages by cutting part of the driven shaft. The adjusting chamber directly communicates with the ring passage irrespective of an axial shift movement or an angular displacement between the driven shaft and the driving rotary body.

Preferably, the driven rotary body has an inner cylindrical surface with splines engaging with the spline member so as to allow the driven shaft to shift in the axial direction.

BRIEF DESCRIPTION OF THE DRAWINGS

The above and other objects, features and advantages of the present invention will become more apparent from the following detailed description which is to be read in conjunction with the attached drawings, in which.

DESCRIPTION OF THE PREFERRED EMBODIMENTS

Figure 1:
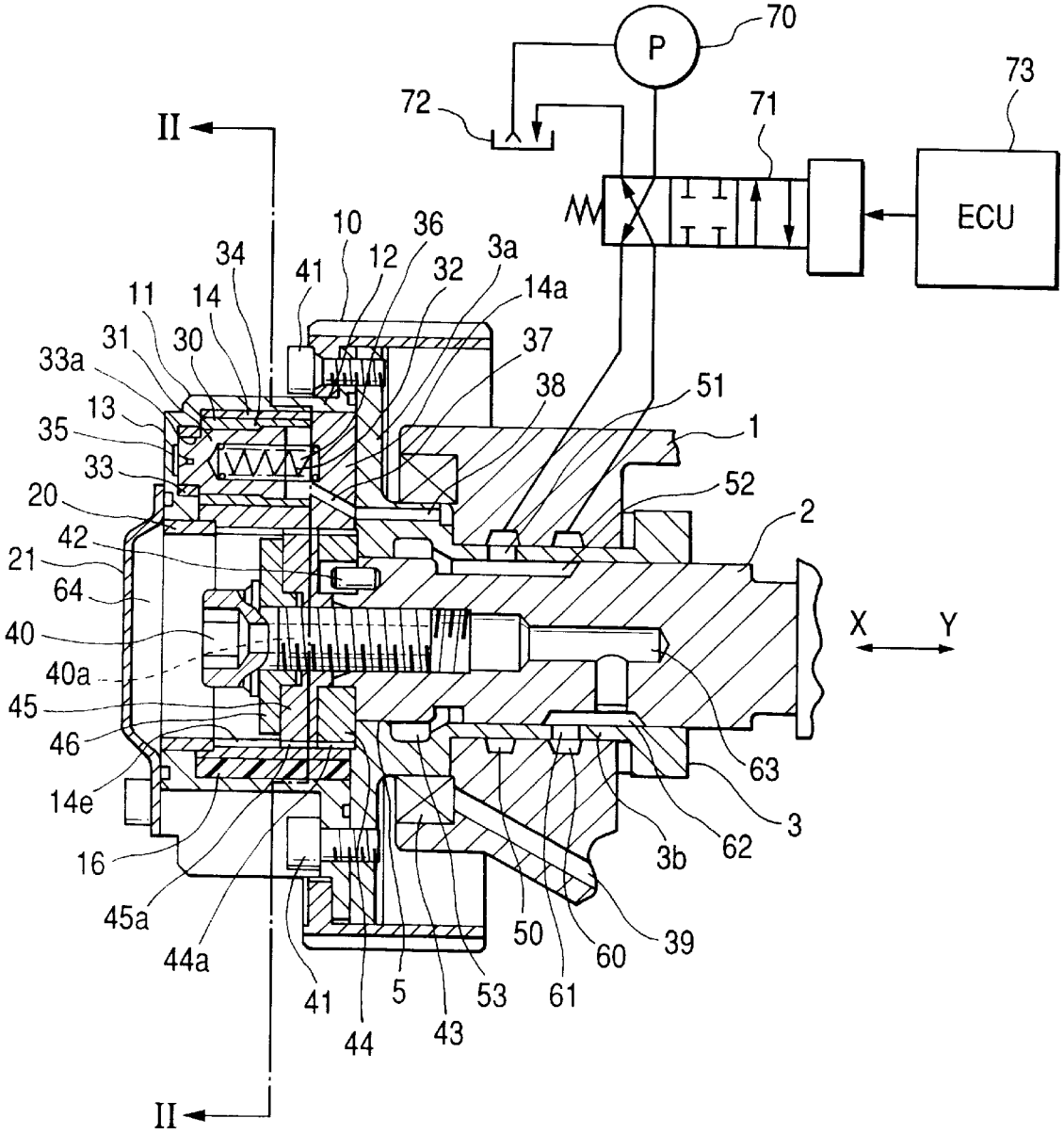
FIG. 1 is a vertical cross-sectional view showing a valve timing control apparatus in accordance with a first embodiment of the present invention.

Preferred embodiments of the present invention will be explained hereinafter with reference to the attached drawings. Identical parts are denoted by the same reference numerals throughout the views.

First Embodiment

FIGS. 1 to 7 are views showing a valve timing control apparatus for an internal combustion engine in accordance with a first embodiment of the present invention. The valve timing control apparatus of the first embodiment is hydraulically controlled for controlling the valve timing of at least one of intake and exhaust valves of an internal combustion engine. This valve timing control apparatus is installed on a cylinder head 1 of the internal combustion engine.

A timing pulley 10 shown in FIG. 1 is driven via a timing belt (not shown) by a crank shaft (not shown) acting as a drive shaft of the internal combustion engine. In other words, the timing pulley 10 rotates in synchronism with the crank shaft of the internal combustion engine. A rear member 3 comprises a plate portion 3*a* and a bearing portion 3*b*. The plate portion 3*a*, the timing pulley 10 and a shoe housing 11 are integrally connected by means of a plurality of bolts 41. The timing pulley 10, the shoe housing 11 and the rear member 3 cooperatively constitute a driving rotary body.

A cam shaft 2, serving as a driven shaft, receives a driving force transmitted from the timing pulley 10 to open or close at least one of the intake and exhaust valves (not shown) of the internal combustion engine. The cam shaft 2 has a plurality of cams having different contours defining their cam profiles and aligned in the axial direction. The cam shaft 2 can dislocate in a rotational direction with respect to the timing pulley 10 so as to provide a predetermined rotational phase difference between them. Furthermore, the cam shaft 2 extends along a cylindrical hollow space of the bearing portion 3*b* and is slidable in the axial direction with respect to the bearing portion 3*b* by an axial shifting mechanism (not shown). More specifically, the cam shaft 2 can reciprocate in the axial direction (i.e., in a direction of an arrow X-Y) within a predetermined range defined by a condition shown in FIG. 1 and a condition shown in FIG. 4. When seen from the left direction in FIG. 1, both the timing pulley 10 and the cam shaft 2 rotate in a clockwise direction. Hereinafter, this rotational direction is referred to as an advance direction.

The shoe housing 11 comprises a cylindrical wall 12 and a front portion 13 that are integrally formed. The shoe housing 11 and the plate portion 3*a* of the rear member 3 cooperatively constitute a housing body accommodating a vane rotor 14. The front portion 13 has an opening closed by a cover 21.

Figure 2:
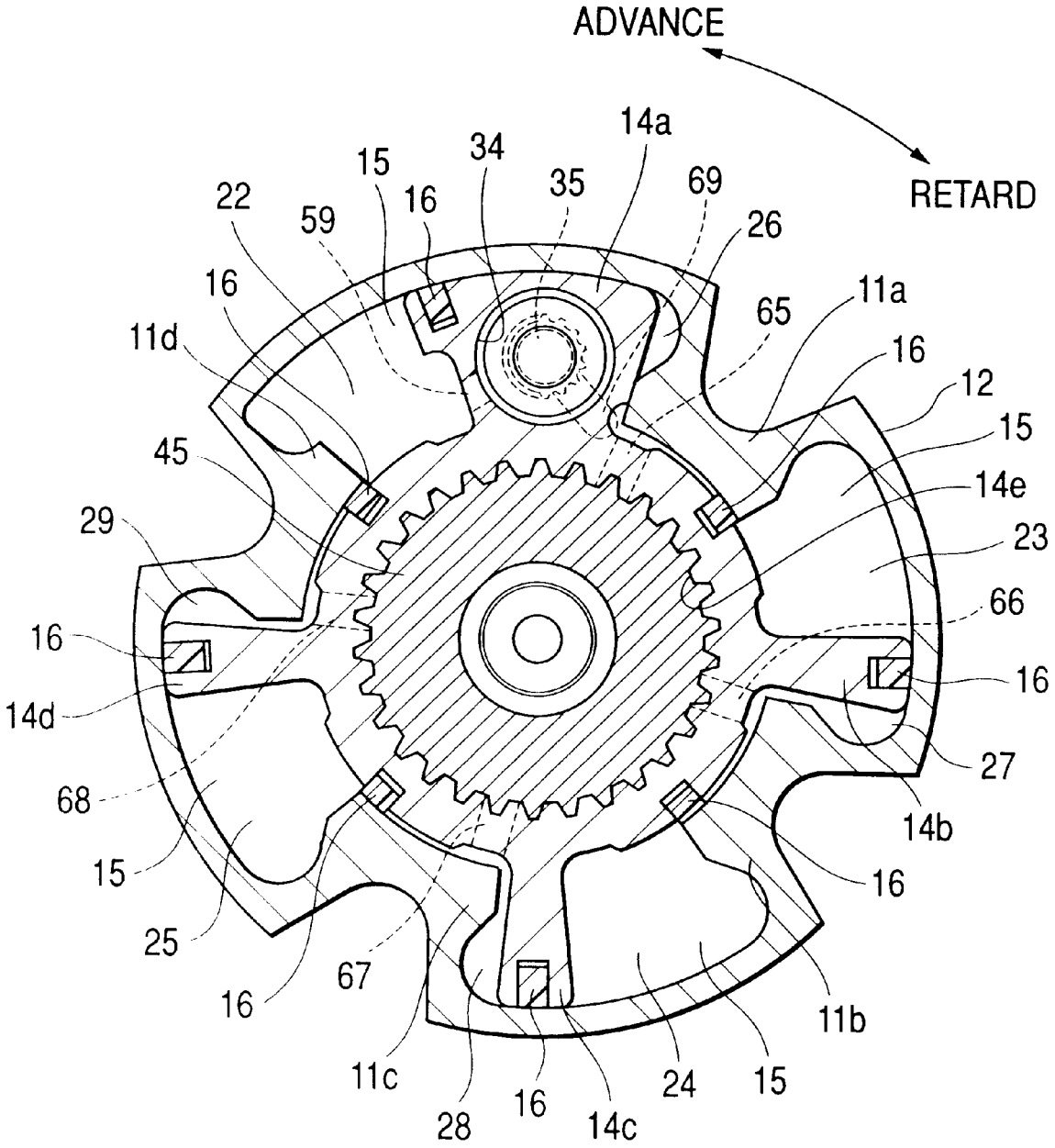
FIG. 2 is a cross-sectional view taken along a line II—II of FIG. 1.

As shown in FIG. 2, the shoe housing 11 comprises a total of four shoes 11*a*, 11*b*, 11*c* and 11*d* substantially equally spaced in a circumferential direction. Each of the shoes 11*a*, 11*b*, 11*c* and 11*d* is configured into a trapezoidal shape. A total of four sector spaces 15, each interposed between two adjacent shoes, serve as accommodation chambers for accommodating vanes 14*a*, 14*b*, 14*c* and 14*d*, respectively. A radially inner cylindrical surface of the shoe housing 11, defining the top of each shoe, has an arc cross section for facing to the cylindrical body of the vane rotor 14 via a small clearance. A radially outer cylindrical surface of the shoe housing 11, defining an outer wall of each sector space 15, has an arc cross section for allowing each vane to angularly displace in the corresponding sector space 15.

The vane rotor 14, serving as a driven rotary body, has axial end surfaces covered by the front portion 13 of the shoe housing 11 and the plate portion 3*a* of the rear member 3, respectively. The vanes 14*a*, 14*b*, 14*c* and 14*d* of the vane rotor 14 are substantially equally spaced in the circumferential direction and slidably engaged in the corresponding sector spaces 15 of the shoe housing 11 via a sealing member 16. FIG. 2 shows an arrow indicating both retard and advance directions of the vane rotor 14 relative to the shoe housing 11. FIG. 2 shows a condition where each vane is angularly shifted at one circumferential end of the corresponding sector space 15. The vane rotor 14 is positioned at the most retarded position. The most retarded position is defined by the angularly shifted vane 14*a* stopped by the shoe 11*a*. The vane rotor 14 has internal splines (i.e., spline keys) 14*e* formed along its inner cylindrical wall.

FIG. 1 shows a positive spline member 44, serving as a first spline member, and a negative spline member 45, serving as a second spline member. These spline members 44 and 45 engage with the vane rotor 14 through a spline engagement. The cam shaft 2, the positive spline member 44 and the negative spline member 45 rotate together with the vane rotor 14 and cause an axial reciprocative movement relative to the vane rotor 14.

A pin 42 securely fixes the positive spline member 44 to an axial end surface of the cam shaft 2, determining the angular position of the positive spline member 44 with respect to the cam shaft 2. The positive spline member 44 has external splines (i.e., spline keys) 44*a* formed on its outer cylindrical wall. The negative spline member 45 is positioned behind the positive spline member 44 when seen from the cam shaft 2 (i.e., from the right direction in FIG. 1 or 2). The negative spline member 45 has external splines (i.e., spline keys) 45*a* formed on its outer cylindrical wall. A pressing member 46, having a diameter smaller than those of the positive spline member 44 and the negative spline member 45, is positioned behind the negative spline member 45 when seen from the cam shaft 2. The positive spline member 44, the negative spline member 45 and the pressing member 46 are securely fixed together to the cam shaft 2 by means of a bolt 40.

Figure 3A:
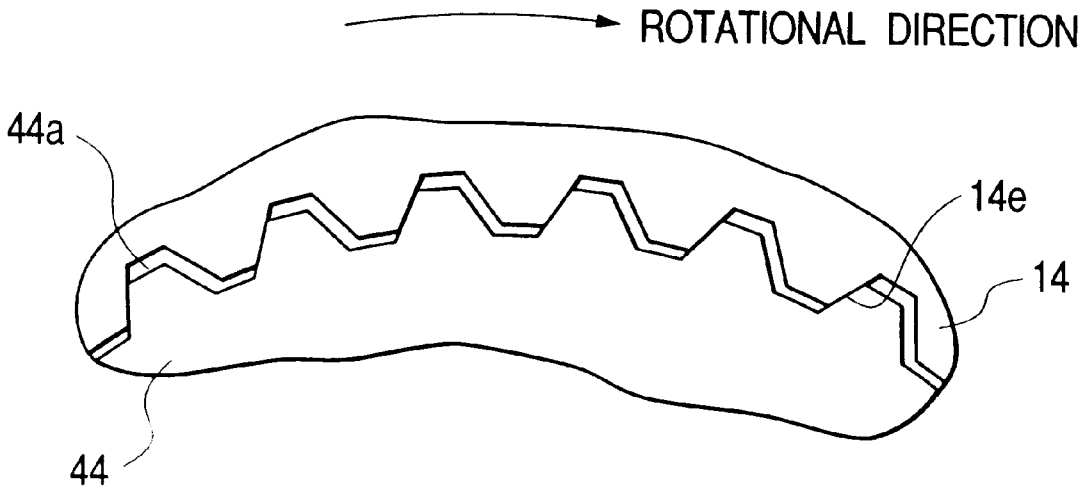
FIG. 3A is a view illustrating a spline engagement between a vane rotor and a positive spline member in accordance with the first embodiment of the present invention.
Figure 3B:
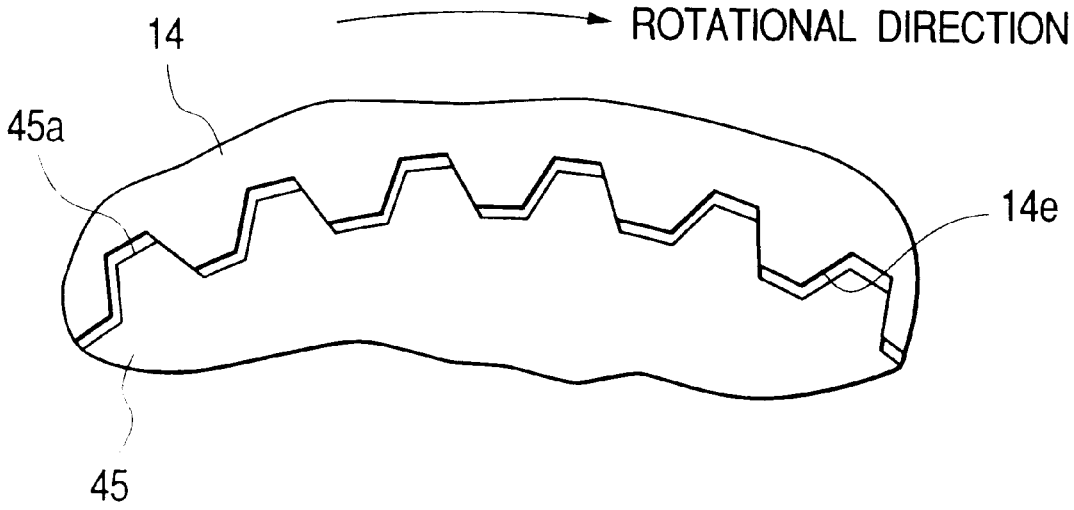
FIG. 3B is a view illustrating a spline engagement between the vane rotor and a negative spline member in accordance with the first embodiment of the present invention.

An angular relationship between the positive spline member 44 and the negative spline member 45, when they are press fitted, is determined in such a manner that any backlash can be eliminated. More specifically, as shown in FIG. 3A, each external spline 44*a* formed on the positive spline member 44 is brought into contact at its trailing side with a mating internal spline 14*e* of the vane rotor 14, forming no backlash between them in a direction opposed to the rotational direction. On the other hand, each external spline 45*a* formed on the negative spline member 45 is brought into contact at its leading side with a mating internal spline 14*e* of the vane rotor 14, forming no backlash between them in the same direction as the rotational direction as shown in FIG. 3B. Then, the press-fitted assembly of the positive spline member 44 and the negative spline member 45 is fixed to the cam shaft 2.

The cam shaft 2 can angularly dislocate along the inner cylindrical wall of the bearing portion 3*b*. The bushing sleeve 20 can angularly dislocate along the inner cylindrical wall of the front portion 13. Accordingly, the cam shaft 2 and the vane rotor 14 are coaxially assembled to the timing pulley 10 and the shoe housing 11 and are rotatable relative to the timing pulley 10 and the shoe housing 11.

As shown in FIG. 2, the seal member 16 is coupled in a recess formed at a radial outer end of each vane of the vane rotor 14. A small radial clearance is provided between the radial outer end of each vane and the inner cylindrical wall 12 of the shoe housing 11, i.e., the radially outer cylindrical surface of the shoe housing 11 defining the sector space 15. The seal member 16 prevents hydraulic oil from leaking via this clearance from one oil chamber to an adjacent oil chamber. A leaf spring urges each seal member 16 toward the inner cylindrical wall 12.

As shown in FIG. 1, a guide ring 30 is press fitted into an inner wall of the vane 14*a* and held by the vane 14*a*. A stopper piston 31, serving as a locking member, is inserted into the guide ring 30. The stopper piston 31 is configured into a cup shape with a bottom. The stopper piston 31, accommodated in the guide ring 30, is slidable in the axial direction of the cam shaft 2. A spring 32, placed in the inner cylindrical hollow space of the stopper piston 31, urges the stopper piston 31 toward the front portion 13. A coupling ring 33 is securely held in a coupling hole formed in the front portion 13. A tapered bore 33*a*, serving as a member engageable with the locking member, is formed on an inner cylindrical wall of the coupling ring 33. The stopper pin 31 is engageable with the tapered bore 33*a* when the vane rotor 14 stays at the most retarded position shown in FIG. 2. In other words, the angular position of the vane rotor 14 with respect to the shoe housing 11 is fixed to the most retarded position by the stopper pin 31 locked with the tapered bore 33*a*. In this manner, the stopper piston 31, the spring 32 and the tapered bore 33*a* cooperatively constitute a locking mechanism.

An oil chamber 34, serving as a relief chamber, is formed between an outer cylindrical wall of the stopper piston 31 and an inner wall of the guide ring 30. The oil chamber 34 communicates with a retard oil chamber 22 via an oil passage 59, as shown in FIG. 2. A hydraulic oil pressure of the oil chamber 34 acts on a pressure-receiving surface of the stopper piston 31 to pull the stopper piston 31 out of the tapered bore 33*a*. When the retard oil chamber 22 is filled with hydraulic oil having a predetermined pressure, the stopper piston 31 exits from the tapered bore 33*a* against the urgent force of the spring 32.

An oil chamber 35 ahead of the stopper piston 31 serves as a relief chamber. The oil chamber 35 communicates with an advance oil chamber 26 via an oil passage 69 as shown in FIG. 2. A hydraulic oil pressure of the oil chamber 35 acts on a front end pressure-receiving surface of the stopper piston 31 to pull the stopper piston 31 out of the tapered bore 33*a*. When the advance oil chamber 26 is filled with hydraulic oil having a predetermined pressure, the stopper piston 31 exits from the tapered bore 33*a* against the urgent force of the spring 32.

As described above, the urgent force of the spring 32 forces the stopper piston 31 to slide into the tapered bore 33*a* when the vane rotor 14 is located at the most retarded position with respect to the shoe housing 11, i.e., when the cam shaft 2 is located at the most retarded position with respect to the crank shaft.

As shown in FIG. 1, a communication passage 37, located closely to the rear member 3 near the vane 14*a*, communicates with a back-pressure chamber 36 of the stopper piston 31. The communication passage 37 communicates with a communication passage 38 formed in the rear member 3 when the vane rotor 14 stays at the most retarded position with respect to the shoe housing 11. The communication passage 38 communicates with a communication passage 39 along a periphery of the oil seal 43. The communication passage 39 communicates with an oil lubrication space (not shown) and is opened to the air. Accordingly, when the vane rotor 14 stays at the most retarded position with respect to the shoe housing 11, the back-pressure chamber is opened to the air. The stopper piston 31 can freely shift at the most retarded position. When the vane rotor 14 rotates in the advance direction from the most retarded position, the stopper piston 31 is not engageable with the tapered bore 33*a*. This advance movement of the vane rotor 14 disconnects the communication passage 37 from the communication passage 38.

As shown in FIG. 2, the retard oil chamber 22 is defined between the shoe 11*d* and the vane 14*a*. A retard oil chamber 23 is interposed between the shoe 11*a* and the vane 14*b*. A retard oil chamber 24 is interposed between the shoe 11*b* and the vane 14*c*. A retard oil chamber 25 is interposed between the shoe 11*c* and the vane 14*d*. The advance oil chamber 26 is interposed between the shoe 11*a* and the vane 14*a*. An advance oil chamber 27 is interposed between the shoe 11*b* and the vane 14*b*. An advance oil chamber 28 is interposed between the shoe 11*c* and the vane 14*c*. An advance oil chamber 29 is interposed between the shoe 11*d* and the vane 14*d*. Each oil chamber serves as a hydraulic actuation chamber.

Figure 5:
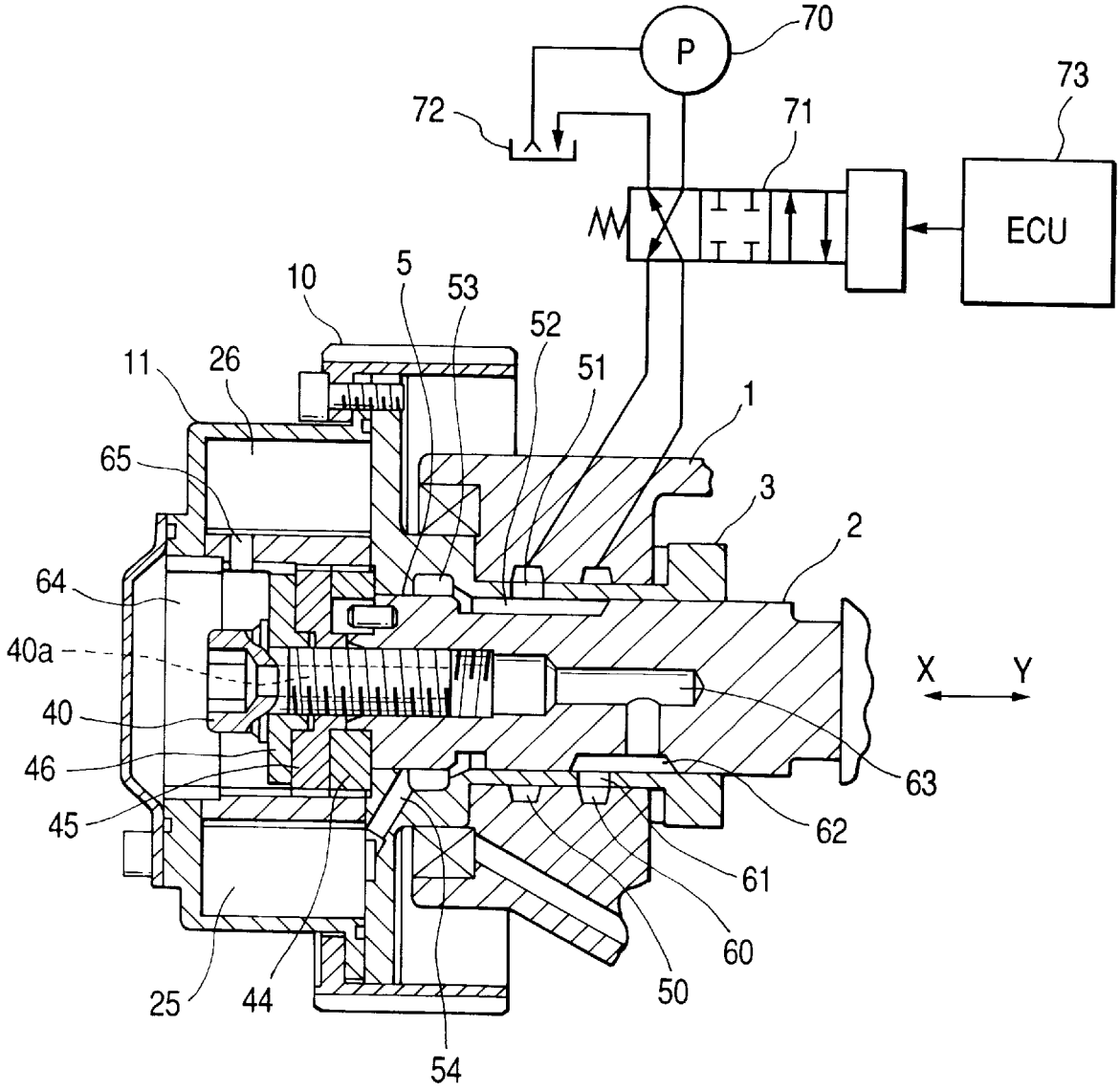
FIG. 5 is a vertical cross-sectional view showing details of oil passages supplying hydraulic oil to oil chambers for displacing the vane rotor in accordance with the first embodiment of the present invention.

The cylinder head 1 has ring oil passages 50 and 60 formed along its inner cylindrical wall as shown in FIG. 5. A switching valve 71 selectively connects each of the ring oil passages 50 and 60 to an oil pump 70 serving as a hydraulic power source or a drain 72 in response to a control signal sent from an engine control apparatus (ECU) 73.

Figure 6:
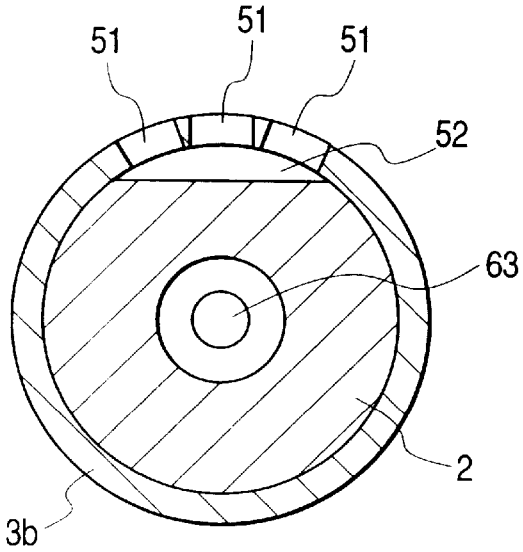
FIGS. 6 and 7 are vertical cross-sectional views showing oil passages formed in the cam shaft and a bearing portion in accordance with the first embodiment of the present invention.

FIG. 6 shows three communication holes 51 extending across the cylindrical wall of the bearing portion 3*b*. The cam shaft 2 has a cutout formed along a chord of its circular cross section to provide a segmental oil chamber 52 defined by an arc of the bearing portion 3*b* and the chord of the cam shaft 2. This oil chamber 52 serves as an adjusting chamber. FIG. 5 shows a ring oil passage 53 formed along the cylindrical wall the bearing portion 3*b*. The plate portion 3*a* has a plurality of oil passages 54 extending to respective retard oil chambers 22, 23, 24 and 25. The hydraulic oil, generated from the oil pump 70, flows into the retard oil chambers 22, 23, 24 and 25 from the oil passage 50 via the communication holes 51, the oil chamber 52, the ring oil passage 53 and the plurality of oil passages 54.

Figure 4:
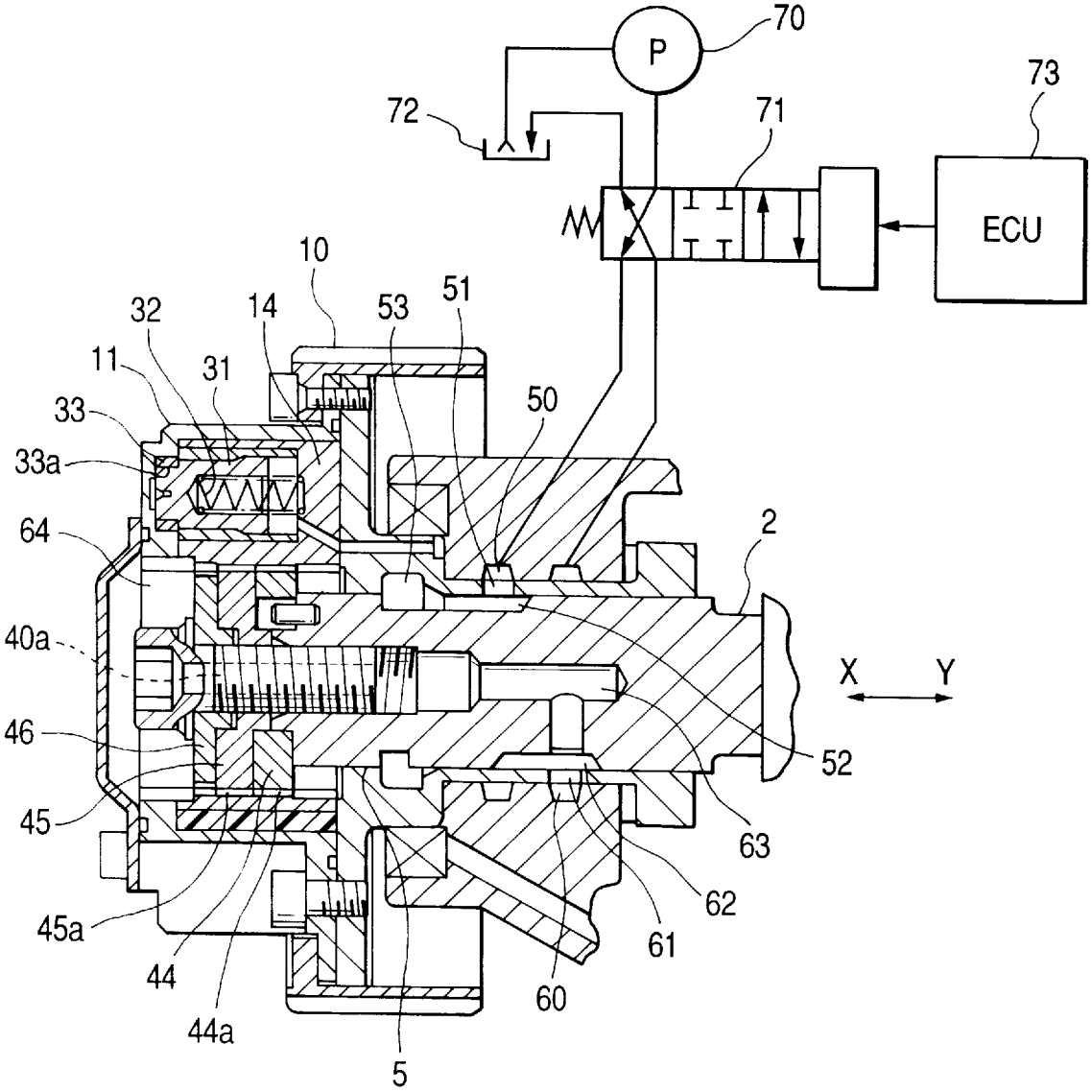
FIG. 4 is a vertical cross-sectional view showing a cam shaft shifted in an axial direction in the valve timing control apparatus shown in FIG. 1.

The oil chamber 52, serving as an adjusting chamber, always and directly communicates with the ring oil passage 53 irrespective of a relative axial shift movement between the bearing portion 3*b* and the cam shaft 2 shown by FIGS. 1 and 4. Furthermore, the oil chamber 52 directly communicates with the ring oil passage 53 irrespective of a relative angular rotational displacement between the bearing portion 3*b* and the cam shaft 2. A slide portion 5 between the outer cylindrical wall of the cam shaft 2 and the internal cylindrical wall of the bearing portion 3*b* seals an oil chamber 64 from the oil passage 53 supplying the hydraulic oil to each retard oil chamber. A seal length of the slide portion 5 is constant within a region the cam shaft 2 shifts in the axial direction.

Figure 7:
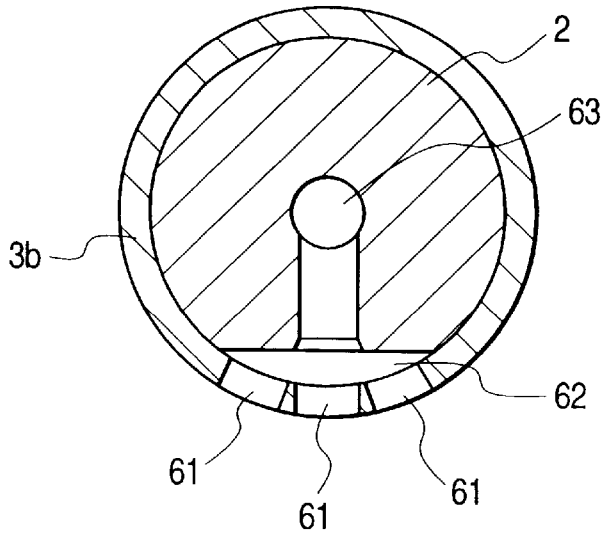

FIG. 7 shows three communication holes 61 extending across the cylindrical wall of the bearing portion 3*b*. The cam shaft 2 has a cutout formed along a chord of its circular cross section to provide a segmental oil chamber 62 defined by an arc of the bearing portion 3*b* and the chord of the cam shaft 2. The cam shaft 2 has an oil passage 63 extending along an axial center thereof. The bolt 40 has an oil passage 40*a* extending along an axial center thereof. The cam shaft 2 has an oil chamber 64 formed at an axial center thereof. The vane rotor 14 has radially extending oil passages 65, 66, 67 and 68 as shown in FIG. 2. The hydraulic oil, generated from the oil pump 70, flows into the advance oil chambers 26, 27, 28 and 29 from the oil passage 60 via the communication holes 61, the oil chamber 62, the oil passage 63, the oil passage 40*a*, the oil chamber 64 and the oil passages 66, 66, 67 and 68.

The above-described valve timing control apparatus operates in the following manner.

Figure 8:
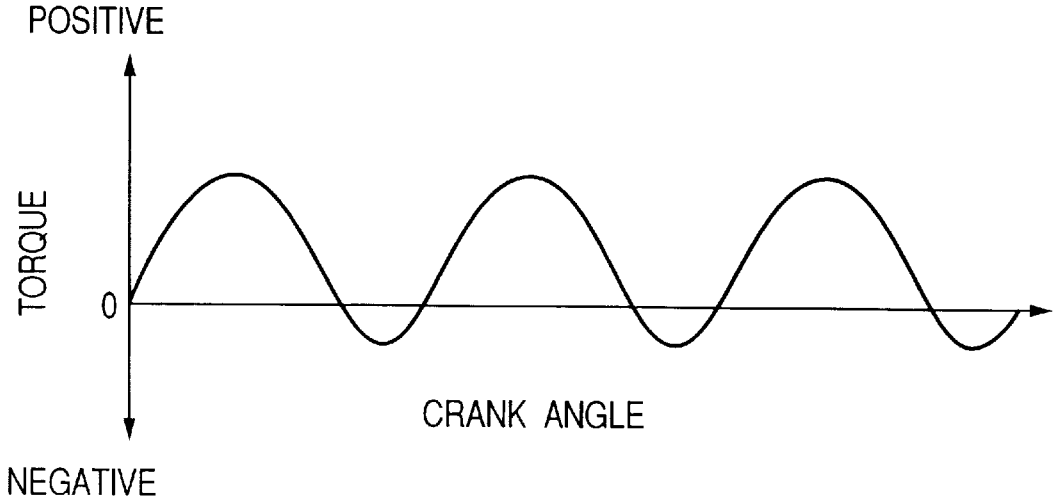
FIG. 8 is a graph showing a variation of a torque applied on the cam shaft.

No hydraulic oil is introduced into the oil chambers 34 and 35 from the oil pump 70 when the engine is stopped. The vane rotor 14 is positioned at the most retarded position with respect to the shoe housing 11 as shown in FIGS. 1 and 2. The stopper piston 31, urged by the spring 32, enters into the tapered bore 33*a*. This engagement between the stopper piston 31 and the tapered bore 33*a* firmly locks the vane rotor 14 with the shoe housing 11. Although the cam shaft 2 is subjected to a torque variation in accordance with the actuation of the intake valve as shown in FIG. 8, no hammering noise is generated between the shoe housing 11 and the vane rotor 14 because of the firm locking between them.

Furthermore, when the cam shaft 2 receives a positive torque variation, the positive torque acting in a direction opposed to the rotational direction is received by the positive spline member 44 through a spline engagement between the external splines 44*a* and the internal splines 14*e* of the vane rotor 14. When the cam shaft 2 receives a negative torque variation, the negative torque acting in the same direction as the rotational direction is received by the negative spline member 45 through a spline engagement between the external splines 45*a* and the internal splines 14*e* of the vane rotor 14. Accordingly, no hammering noise is generated between the splines (i.e., spline keys) when the cam shaft 2 is subjected to a positive or a negative torque variation.

After the engine is started, the oil pump 70 supplies the hydraulic oil to respective retard oil chambers. The oil chamber 34 receives the hydraulic oil from the retard oil chamber 22 via the oil passage 59. When the pressure level of the hydraulic oil supplied in the oil chamber 34 exceeds a predetermined value, the stopper piston 31 exits from the tapered bore 33*a* against the urgent force of the spring 32. The disengagement of the stopper piston 31 from the tapered bore 33*a* allows the vane rotor 14 to cause a free angular displacement relative to the shoe housing 11. However, the vane rotor 14 receives a hydraulic pressure acting in the retard direction from each retard chamber. As a result, the vane rotor 14 is held at the most retarded position shown in FIG. 2. No hammering noise is generated between the vane rotor 14 and the shoe housing 11 even when the cam shaft 2 is subjected to a positive or negative torque variation in accordance with the actuation of the intake valve.

Next, to rotate the vane rotor 14 in the advance direction from the most retarded position shown in FIG. 1, the ECU 73 sends a control signal to the switching valve 71. In response to this control signal, the switching valve 71 switches the oil passages to open each retard oil chamber to the air and supply the hydraulic oil to respective advance chambers. The hydraulic oil enters into the oil chamber 35 from the advance oil chamber 26 via the oil passage 69, holding the condition where the stopper piston 31 is disengaged from the tapered bore 33*a*. When the pressure level of the hydraulic oil supplied in each advance oil chamber exceeds a predetermined value, the vane rotor 14 starts rotating in the advance direction from the most retarded position, dislocating the stopper piston 31 to an angularly offset position from the tapered bore 33*a*.

During an operation of the engine, the ECU 73 generates a control signal to optimize the valve timing of each intake or exhaust valve in accordance with engine driving conditions. The hydraulic pressures in the retard and advance oil chambers are precisely changed by the switching valve 71 controlled in response to this control signal, so as to adjust the angular dislocation of the vane rotor 14 relative to the shoe housing 11, i.e., so as to optimize a relative phase difference between the crank shaft and the cam shaft 2. Accordingly, the valve timing of each intake valve can be properly controlled. Furthermore, by shifting the cam shaft 2 in the axial direction by the axial shifting mechanism (not shown), the valve timing and/or a lift amount of each intake or exhaust valve can be controlled.

According to the above-described first embodiment, the positive spline member 44 and the negative spline member 45 are securely fixed to the cam shaft 2 keeping the angular phase relationship between them in such a manner that, in both rotational and anti-rotational directions, no backlash is formed between the internal splines 14*e* of the vane rotor 14 and external splines of the positive and negative spline members 44 and 45. Accordingly, it becomes possible to prevent the hammer noise from generating from the spline engagement between the vane rotor 14 and each of the positive and negative spline members 44 and 45 even when the cam shaft 2 is subjected to a positive or negative torque variation.

Second Embodiment

Figure 9:
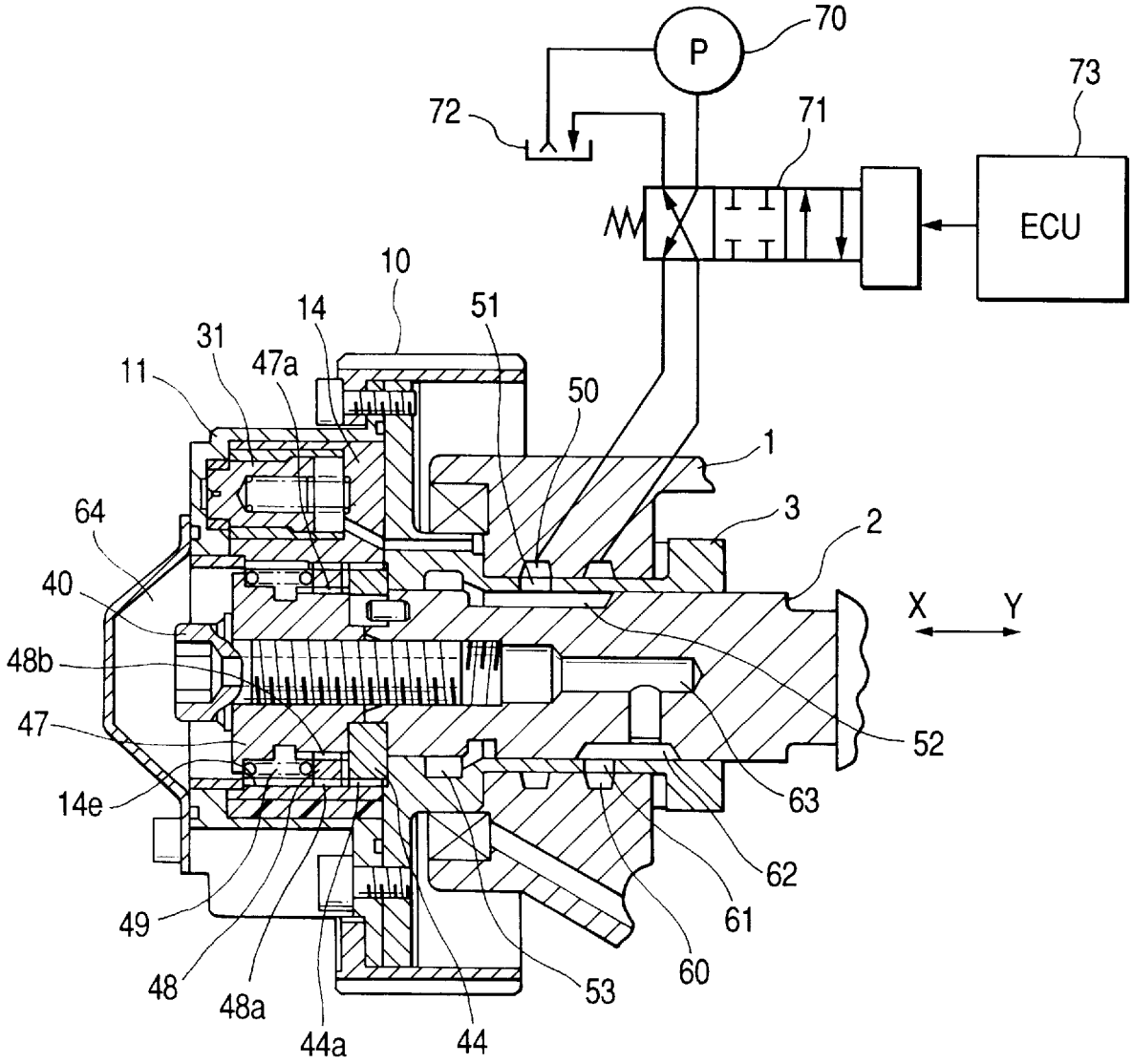
FIG. 9 is a vertical cross-sectional view showing a valve timing control apparatus in accordance with a second embodiment of the present invention.

FIGS. 9, 10 and 11 are views showing a valve timing control apparatus for an internal combustion engine in accordance with a second embodiment of the present invention.

FIG. 9 shows the positive spline member 44 and a smaller-diameter member 47 cooperatively constituting the first spline member and securely fixed to the cam shaft 2 by means of the bolt 40. The smaller-diameter member 47 has an outer diameter smaller than that of the positive spline member 44. A plurality of external helical splines (i.e., spline keys) 47*a* are formed on an outer cylindrical wall of the smaller-diameter member 47. A negative spline member 48, serving as the second spline member, has internal helical splines (i.e., spline keys) 48*b* formed on its inner cylindrical wall. The internal helical splines 48*b* of the negative spline member 48 mesh with the external helical splines 47*a* of the smaller-diameter member 47 so as to form a helical spline engagement. The negative spline member 48 has an outer cylindrical wall on which external splines (i.e., spline keys) 48*a* are provided. The external splines 48*a* of the negative spline member 48 mesh with the vane rotor 14.

Figure 10A:
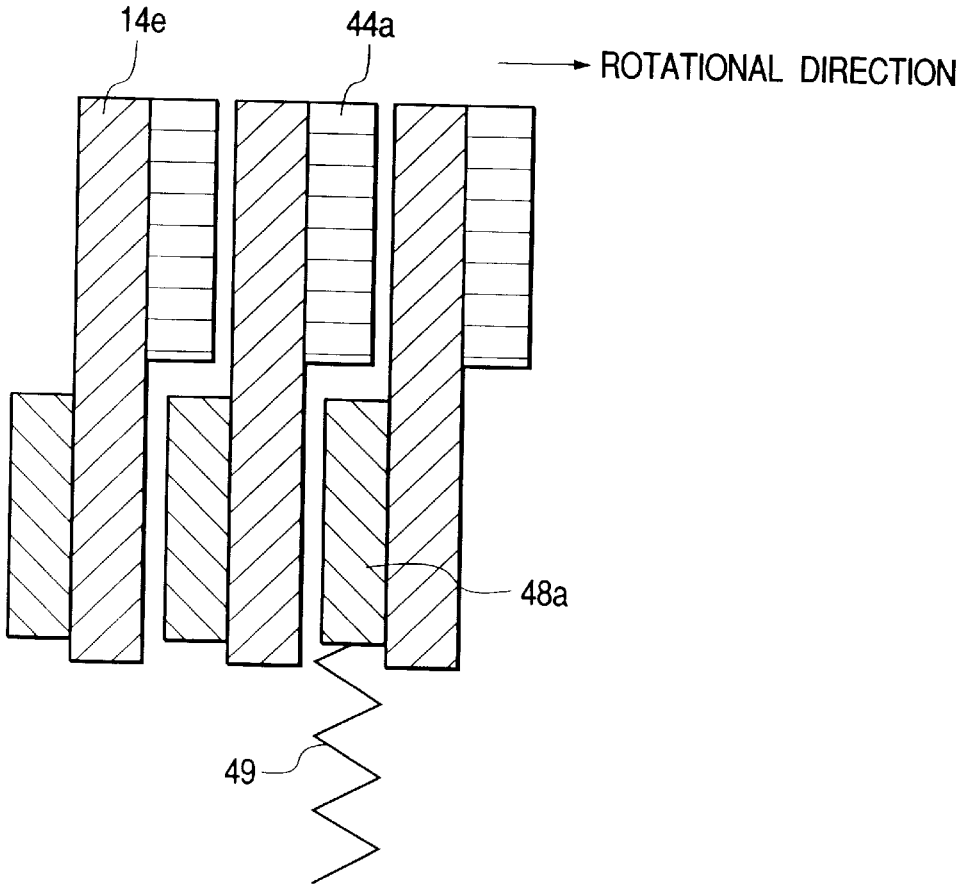
FIG. 10A is a view illustrating a spline engagement between the vane rotor and positive and negative spline members, seen along an axial direction, in accordance with the second embodiment of the present invention.
Figure 10B:
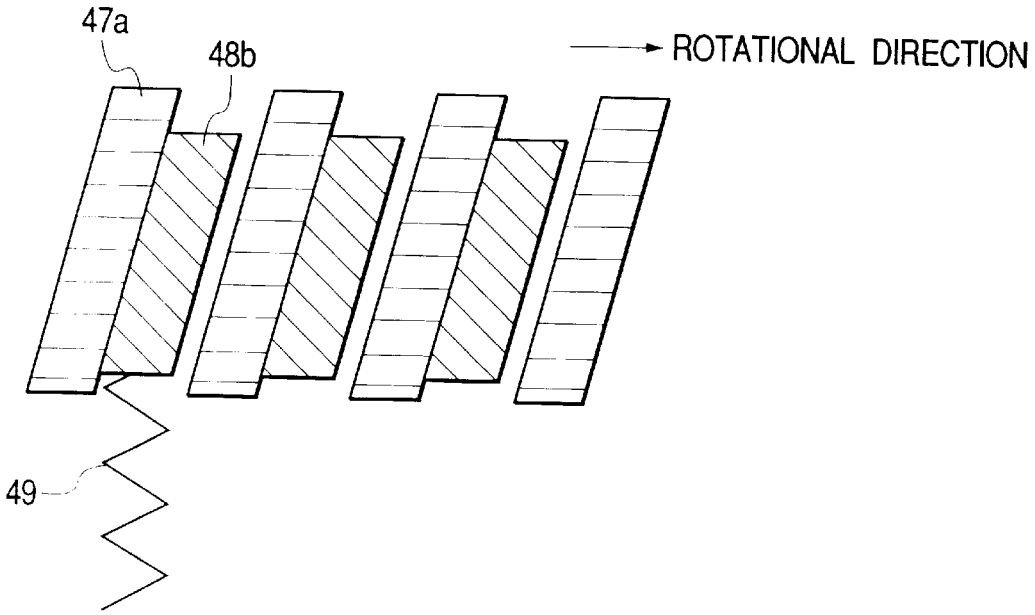
FIG. 10B is a view illustrating a helical spline engagement between the negative spline member and a smaller-diameter member, seen along the axial direction, in accordance with the second embodiment of the present invention.
Figure 11A:
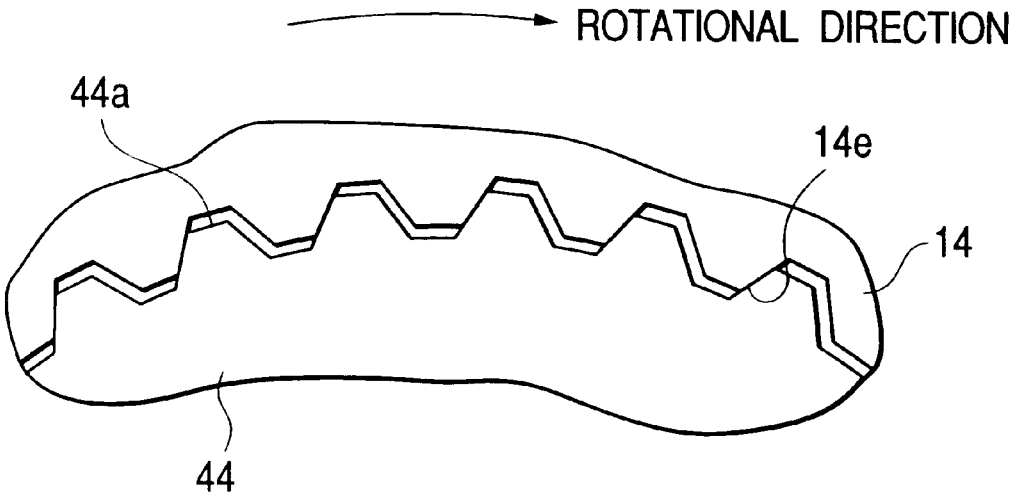
FIG. 11A is a view illustrating the spline engagement between the vane rotor and the positive spline member, seen along a radial direction, in accordance with the second embodiment of the present invention.
Figure 11B:
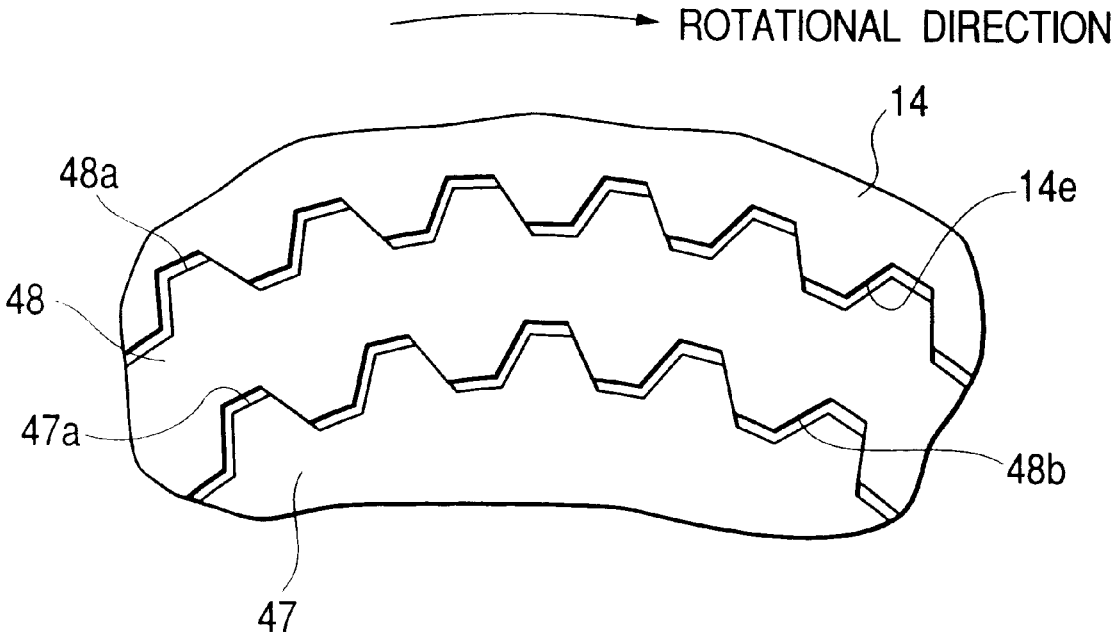
Fig. 11B is a view illustrating the spline engagement between the vane rotor and the negative spline member as well as the helical spline engagement between the negative spline member and the smaller-diameter member, seen along the radial direction, in accordance with the second embodiment of the present invention.

The negative spline member 48 is resiliently urged by a spring 49 in the axial direction. The urgent force of the spring 49 acts to press the negative spline member 48 toward a direction opposed to the rotational direction. Thus, each internal helical spline 48*b* formed on the negative spline member 48 is brought into contact at its trailing side with (i.e., received by) a mating external helical spline 47*a* of the smaller diameter member 47 as shown in Figs. 10B and 11B. The helical spline engagement (splines 47*a* and 48*b*) between the negative spline member 48 and the smaller-diameter member 47 and the spring 49 urging the smaller-diameter member 48 cooperatively serve as an urging means.

The resilient force of the spring 49 urges the smaller-diameter member 47 and the positive spline member 44 in the direction opposed to the rotational direction. Thus, each external spline 44*a* formed on the positive spline member 44 is brought into contact at its trailing side with (i.e., received by) a mating internal spline 14*e* of the vane rotor 14 as shown in FIGS. 10A and 11A. The negative spline member 48 pushes the smaller-diameter member 47 in the direction opposed to the rotational direction. The negative spline member 48 itself is urged in the same direction as the rotational direction. Thus, each external spline 48*a* is brought into contact at its leading side with (i.e., received by) a mating internal spline 14*e* of the vane rotor 14.

According to the second embodiment, the negative spline member 48 is engaged with the smaller-diameter member 47 through the helical spline engagement. The spring 49 resiliently urges the negative spline member 48 in the axial direction. The external splines 44*a* of the positive spline member 44 and the external splines 48*a* of the negative spline member 48 mesh with the internal splines 14*e* of the vane rotor 14 without causing any backlash between them in both the rotational and anti-rotational directions. The vane rotor 14 serves as the driven rotary body. Accordingly, it becomes possible to prevent the hammer noise from generating from the spline engagement between the vane rotor 14 and each of the positive and negative spline members 44 and 45 even when the cam shaft 2 is subjected to a positive or negative torque variation.

Third Embodiment

Figure 12:
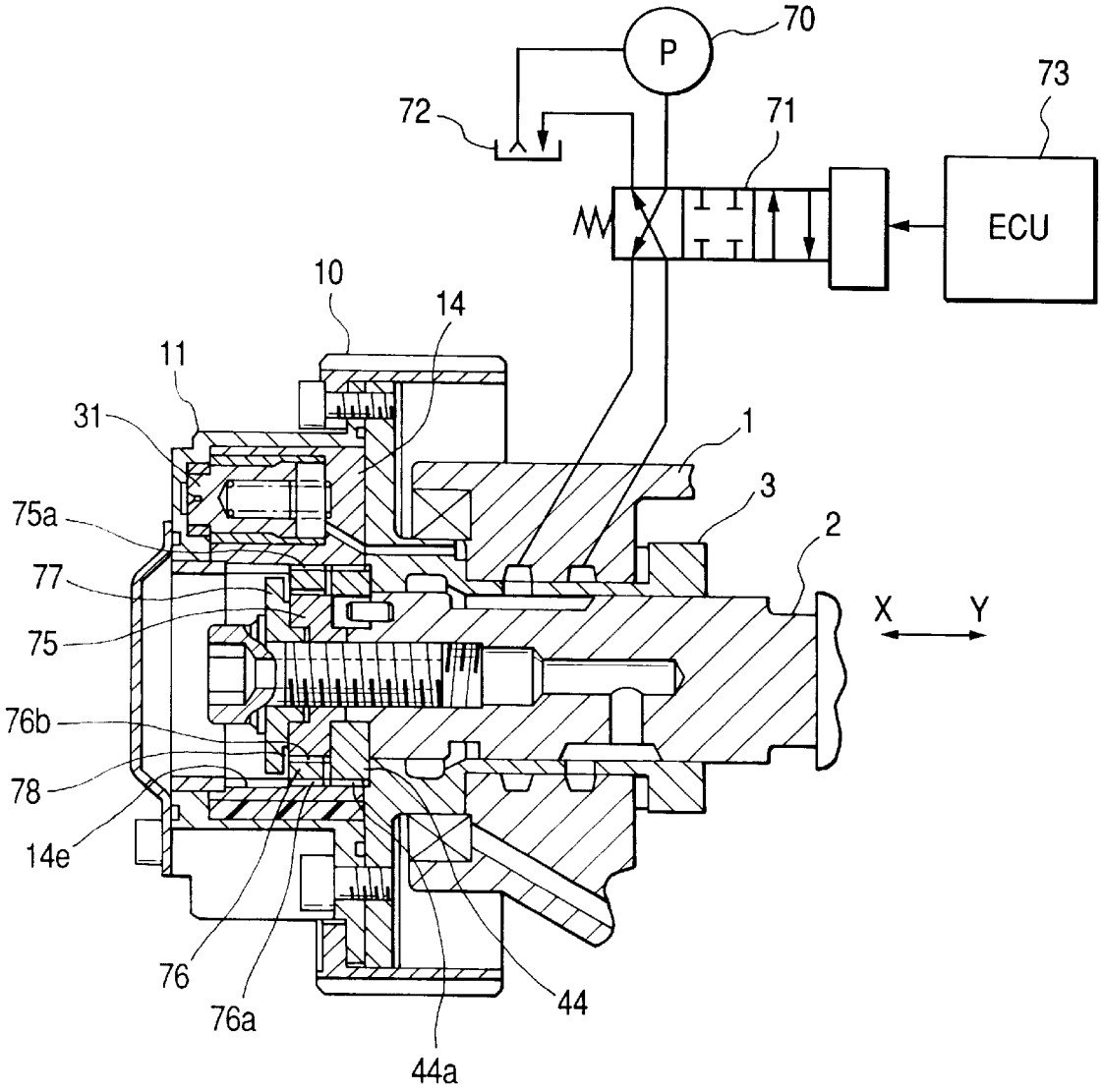
FIG. 12 is a vertical cross-sectional view showing a valve timing control apparatus in accordance with a third embodiment of the present invention.

FIG. 12 is a view showing a valve timing control apparatus for an internal combustion engine in accordance with a third embodiment of the present invention.

The third embodiment differs from the second embodiment in that a negative spline member 76, serving as the second spline member, is resiliently urged by a disc spring 78 serving as a spring member. A smaller-diameter member 75 and a pressing member 77 differ in configuration from the above-described smaller-diameter member 47 and the pressing member 46, respectively. However, each component operates in the same manner as in the above-described embodiments. By resiliently urging the negative spline member 76 by the disc spring 78, an axial length of the apparatus can be reduced.

Fourth Embodiment

Figure 13:
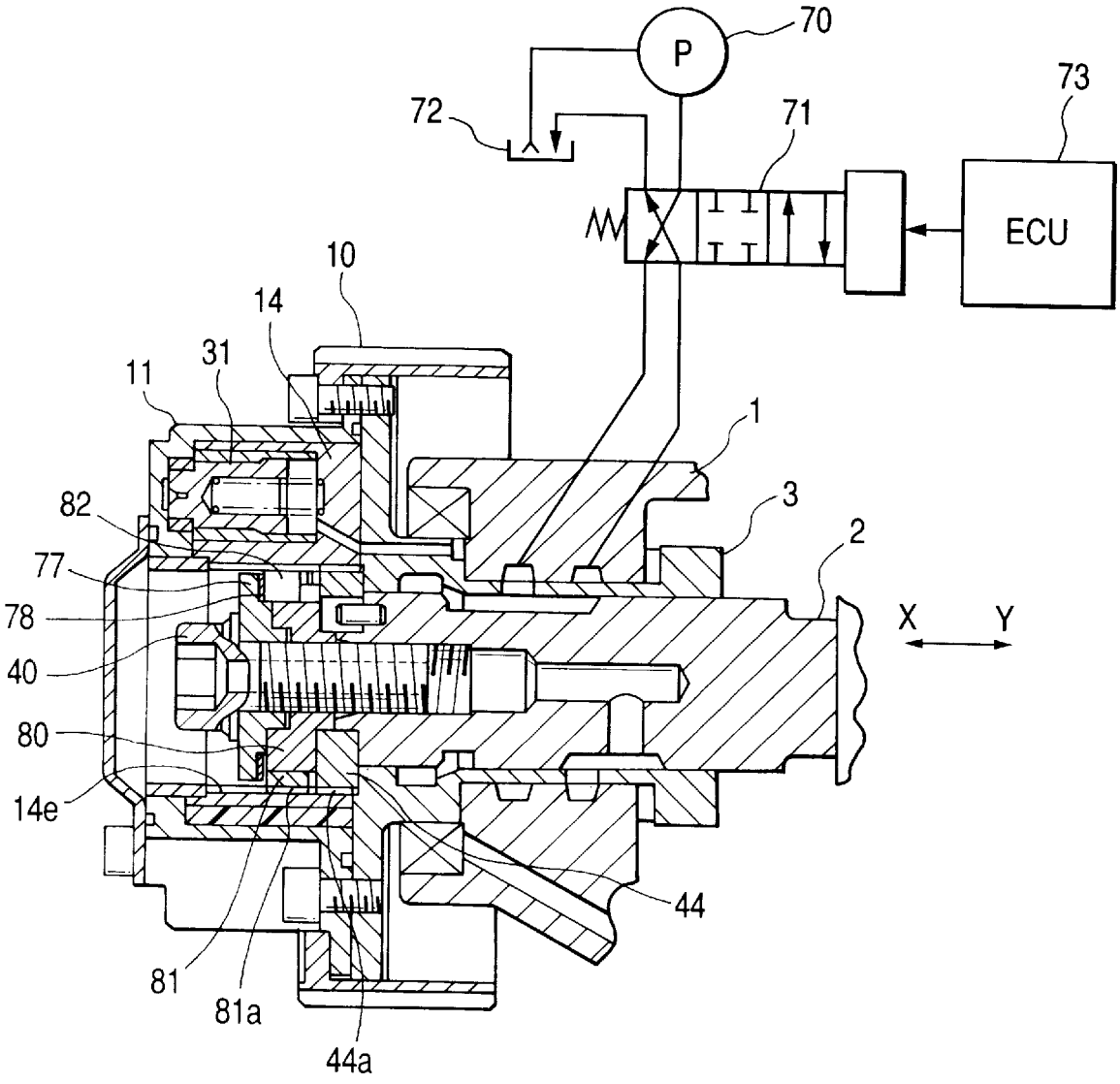
FIG. 13 is a vertical cross-sectional view showing a valve timing control apparatus in accordance with a fourth embodiment of the present invention.
Figure 14A:
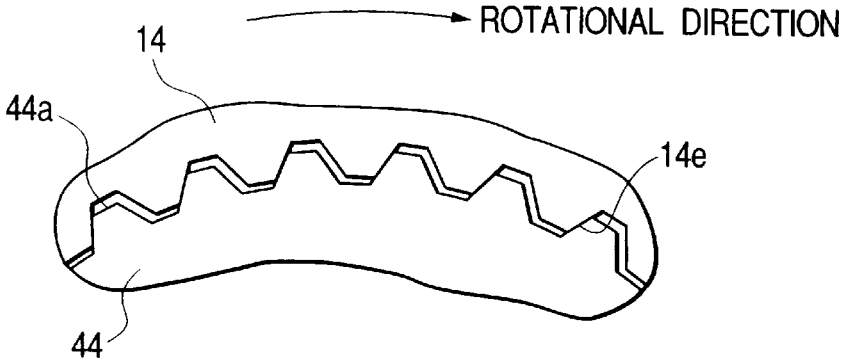
FIG. 14A is a view illustrating a spline engagement between the vane rotor and a positive spline member, seen along the radial direction, in accordance with the fourth embodiment of the present invention.

FIGS. 13 and 14 are views showing a valve timing control apparatus for an internal combustion engine in accordance with a fourth embodiment of the present invention.

FIG. 13 shows the positive spline member 44 and a smaller-diameter member 80 cooperatively constituting the first spline member and securely fixed to the cam shaft 2 by means of the bolt 40. The smaller-diameter member 80 has an outer diameter smaller than that of the positive spline member 44. No external helical splines are provided on an outer cylindrical surface of the smaller-diameter member 80. A negative spline member 81, serving as the second spline member, is rotatably assembled around the smaller-diameter member 80.

Figure 14B:
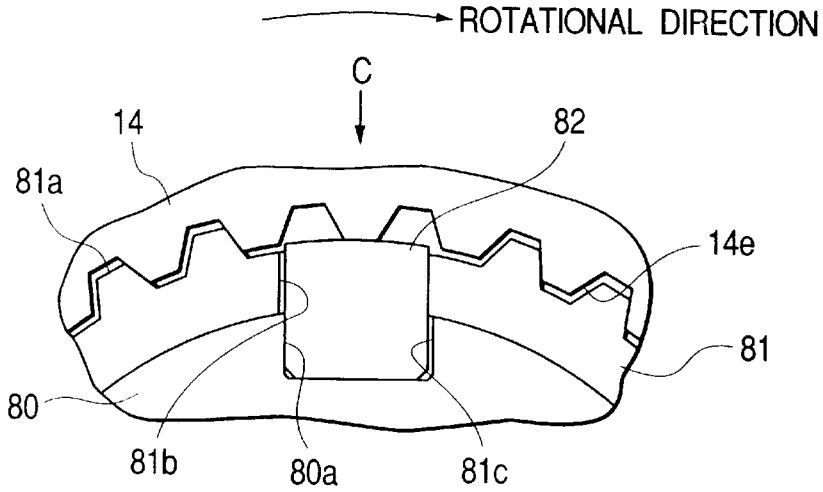
FIG. 14B is a view illustrating an engagement between a wedge member and a negative spline member as well as an engagement between the wedge member and a smaller-diameter member.
Figure 14C:
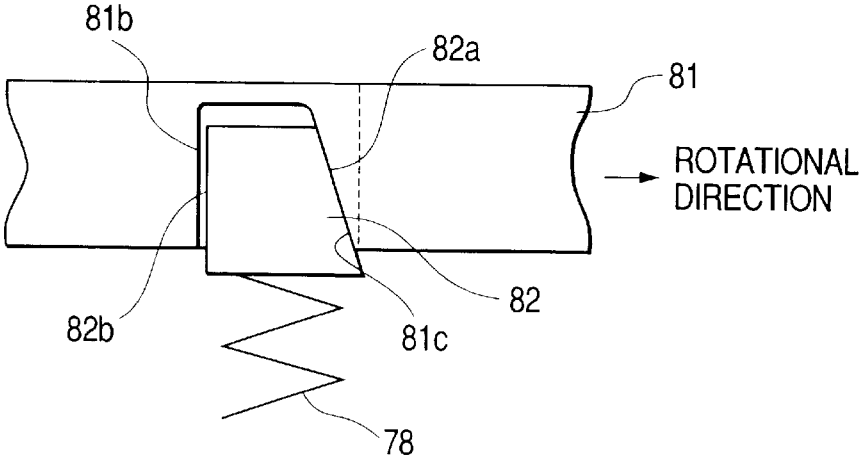
FIG. 14C is a view showing the wedge and the negative spline member seen from a direction of an arrow C shown in FIG. 14B.

FIGS. 14B and 14C show a cutout 80*a* formed on the smaller-diameter member 80 and a cutout 81*b* formed on the negative spline member 81. These cutouts 80*a* and 81*b*, defining a continuous space for accommodating a wedge member 82 resiliently urged by the disc spring 78. The cutout 80*a* has a rectangular cross section, while the other cutout 81*b* has a slant surface 81*c* brought into contact with a corresponding slant surface 82*a* of the wedge 82 for slidably guiding the wedge member 82.

As the disc spring 78 resiliently urges the wedge member 82 in the axial direction (refer to FIG. 14C), the slant surface 82*a* pushes the slant surface 81*c* in the same direction as the rotational direction. Each external spline 81*a* formed on the negative spline member 81 is brought into contact at its leading side with a mating internal spline 14*e* of the vane rotor 14 (refer to FIG. 14B). The smaller-diameter member 80 is brought into contact with a trailing side of the wedge member 82. Thus, the wedge member 82 and the disc spring 78 cooperatively act as an urging means for urging both the positive spline member 44 and the smaller-diameter member 80 in the direction opposed to the rotational direction.

According to the above-described fourth embodiment, the positive spline member 44 and the smaller-diameter member

80 are securely fixed to the bolt 40. The smaller-diameter member 80 is urged in the direction opposed to the rotational direction while the negative spline member 81 is urged in the same direction as the rotational direction. Each external spline 44*a* formed on the positive spline member 44 is brought into contact at its trailing side with a mating internal spline 14*e* of the vane rotor 14. Thus, the external splines 44*a* of the positive spline member 44 and the external splines 81*a* of the negative spline member 81 mesh with the internal splines 14*e* of the vane rotor 14 serving as the driven rotary body without causing any backlash between them in both the rotational and anti-rotational directions.

Accordingly, it becomes possible to prevent the hammer noise from generating from the spline engagement between the vane rotor 14 and each of the positive and negative spline members 44 and 81 even when the cam shaft 2 is subjected to a positive or negative torque variation.

According to the above-described embodiments of the present invention, the cam shaft 2 has the plurality of cams having different contours defining their cam profiles and aligned in the axial direction. This makes it possible to adjust the lift amount and/or the valve timing of each intake or exhaust valve by shifting the cam shaft 2 in the axial direction. Furthermore, a rotational phase difference between the shoe housing 11 and the vane rotor 14 is hydraulically adjustable. This makes it possible to accurately control the valve timing of each intake or exhaust valve. Furthermore, the above-described embodiments of the present invention provide a compact structure suitable for accommodating the cam shaft 2 with different cams so as to be shiftable in the axial direction and for hydraulically controlling the rotational phase difference between the crank shaft and the cam shaft 2.

Furthermore, the above-described embodiments of the present invention use the vane rotor for controlling the rotational phase difference between the crank shaft and the cam shaft. The vane rotor is advantageous in that friction caused in the control mechanism is relatively small and its response is excellent during the control of the rotational phase difference.

However, the present invention does not exclude the use an engagement of hydraulically controlled helical gears for controlling the rotational phase difference between the crank shaft and the cam shaft.

Furthermore, the straight spline engagement between the vane rotor 14 and each of the positive and negative spline members disclosed in the above-described embodiments can be replaced by a comparable or equivalent helical spline engagement. Furthermore, it is possible to integrate the positive spline member and the negative spline member into a single spline member.

Furthermore, in the above-described embodiments of the present invention, the timing pulley used for transmitting the rotational driving force to the cam shaft can be replaced by other comparable or equivalent mechanisms such as a chain sprocket or timing gears. Furthermore, it is possible that the vane rotor receives the driving force from the crank shaft serving as the driving shaft while the cam shaft serving as the driven shaft and the shoe housing rotate integrally.

Needless to say, the valve timing control apparatus of the present invention can be used for controlling either intake or exhaust valves exclusively or, alternatively, for controlling both of the intake and exhaust valves of an internal combustion engine.

This invention may be embodied in several forms without departing from the spirit of essential characteristics thereof. The present embodiments as described are therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. A valve timing control apparatus provided in a driving force transmitting mechanism for transmitting a driving force of an internal combustion engine to a driven shaft with a plurality of cams aligned in an axial direction and having different contours defining cam profiles for opening or closing at least one of intake and exhaust valves, said valve timing control apparatus comprising:

a driving rotary body rotating in synchronism with a driving shaft of said internal combustion engine;

at least one spline member rotating integrally with said driven shaft; and a driven rotary body causing an angular displacement relative to said driving rotary body in response to a hydraulic pressure, said driven rotary body engaging with said spline member through a spline engagement so as to allow said driven shaft to shift in the axial direction, wherein said one of said driving rotary body and said driven rotary body is a vane rotor and the other is a housing accommodating said vane rotor, allowing a relative displacement between said vane rotor and said housing within a predetermined angular region.

2. The valve timing control apparatus in accordance with claim 1, wherein said driven rotary body has an inner cylindrical surface with splines engaging with said spline member so as to allow said driven shaft to shift in the axial direction.

3. The valve timing control apparatus in accordance with claim 1, wherein said spline member comprises a first spline member and a second spline member, each spline formed on said first spline member is brought into contact at its trailing side with a mating spline of said driven rotary body and each spline formed on said second spline member is brought into contact at its leading side with a mating spline of said driven rotary body.

4. The valve timing control apparatus in accordance with claim 3, wherein an urging means is provided for resiliently urging said first spline member in a direction opposed to a rotational direction and for resiliently urging said second spline member in the same direction as the rotational direction.

5. The valve timing control apparatus in accordance with claim 4, wherein said urging means is constituted by one spline member having an inner cylindrical surface engaged through a helical spline engagement with a smaller-diameter member serving as the other spline member, and a spring member resiliently urging said one spline member.

6. The valve timing control apparatus in accordance with claim 4, wherein said urging means is constituted by a wedge member accommodated in a cutout formed in each of said first spline member and said second spline member and a spring pushing said wedge member for resiliently urging said first spline member in the direction opposed to the rotational direction and resiliently urging said second spline member in the same direction as the rotational direction.

7. The valve timing control apparatus in accordance with claim 1, wherein a plurality of hydraulic chambers are provided for hydraulically pushing said driven rotary body to cause said angular displacement relative to said driving rotary body in a retard direction and an advance direction, and a slide portion is provided between said driven shaft and a bearing portion of said driven shaft for providing a sealing between two fluid passages supplying hydraulic fluid to said hydraulic chambers.

8. The valve timing control apparatus in accordance with claim 7, wherein a ring passage is formed along an inner cylindrical wall of said bearing portion so as to communicate with said hydraulic chambers, and an adjusting chamber is provided in one of said two fluid passages by cutting part of said driven shaft, said adjusting chamber directly communicating with said ring passage irrespective of an axial shift movement or an angular displacement between said driven shaft and said driving rotary body.

* * * * *

UNITED STATES PATENT AND TRADEMARK OFFICE

CERTIFICATE OF CORRECTION

PATENT NO. : 6,014,952

DATED : January 18, 2000

INVENTOR(S) : Sato, et. al.

It is certified that error appears in the above-identified patent and that said Letters Patent is hereby corrected as shown below:

Title page, item [30], the second Priority Data, should read -- "10-117157"

Signed and Sealed this

Twenty-fourth Day of October, 2000

*Attest:*

Q. TODD DICKINSON

*Attesting Officer*

*Director of Patents and Trademarks*